US007270096B2

(12) United States Patent
Lancefield et al.

(10) Patent No.: US 7,270,096 B2
(45) Date of Patent: Sep. 18, 2007

(54) VARIABLE PHASE DRIVE MECHANISM

(75) Inventors: Timothy Mark Lancefield, Warwickshire (GB); Richard Alwyn Owen, Oxfordshire (GB)

(73) Assignee: Mechadyne PLC, Kirtlington, Oxford (GB)

( * ) Notice: Subject to any disclaimer, the term of this patent is extended or adjusted under 35 U.S.C. 154(b) by 231 days.

(21) Appl. No.: 11/104,721

(22) Filed: Apr. 11, 2005

(65) Prior Publication Data

US 2005/0226736 A1 Oct. 13, 2005

(30) Foreign Application Priority Data

Apr. 13, 2004 (GB) ..... 0408127.9

(51) Int. Cl.
*F01L 1/34* (2006.01)

(52) U.S. Cl. ..... 123/90.17; 123/90.12; 123/90.15; 123/90.31; 464/1; 464/2; 464/160; 92/5 L; 92/122

(58) Field of Classification Search ..... 123/90.17
See application file for complete search history.

(56) References Cited

U.S. PATENT DOCUMENTS

| | | | | |
|---|---|---|---|---|
| 6,105,543 | A * | 8/2000 | Ogawa | 123/90.17 |
| 6,443,112 | B1 * | 9/2002 | Kinugawa | 123/90.17 |
| 6,520,132 | B2 * | 2/2003 | Todo | 123/90.17 |
| 6,725,817 | B2 * | 4/2004 | Methley et al. | 123/90.17 |

* cited by examiner

*Primary Examiner*—Thomas Denion
*Assistant Examiner*—Kyle M. Riddle
(74) *Attorney, Agent, or Firm*—Smith-Hill and Bedell

(57) ABSTRACT

A twin vane-type phaser is described which is provided with a locking mechanism for locking the drive member to the driven members when the pressure in the working chambers is a below is predetermined value. The locking mechanism comprises two coaxial locking pins 114, 118 mounted in a common bore 110 in the centrally located member 32. The locking pins are resiliently urged apart by a spring 120 into bores in the two outer members 38, 40 and are retracted by pistons 112, 116 when the hydraulic pressure in the working chambers attains the predetermined value.

7 Claims, 4 Drawing Sheets

VARIABLE PHASE DRIVE MECHANISM

CROSS-REFERENCE TO RELATED APPLICATION

This application claims priority of United Kingdom Patent Application No. 0408127.9 filed Apr. 13, 2004.

BACKGROUND OF THE INVENTION

1. Field of the Invention

The present invention relates to a variable phase drive mechanism, also referred to as a phase change mechanism or still more simply as a phaser.

2. Description of the Related Art

It is well known to use a phaser in an internal combustion engine to vary the phase of the camshaft(s) in relation that of the crankshaft so as to allow the opening and closing times of the inlet and/or the exhaust valves within the combustion cycle to be varied. Such phasers have a drive member coupled for rotation with the engine crankshaft, one or more driven members each coupled for rotation with the or a respective camshaft and means for rotating the drive member relative to the driven member(s).

Different types of phasers have been proposed in the prior art which are actuated mechanically and electrically but the present invention is concerned only with phasers, for example vane-type phasers, that rely on the presence of a hydraulic pressure, such as the engine oil pressure, to be able to effect a relative rotation between the drive and driven members.

A problem is encountered with such phasers when the required hydraulic pressure is low, as happens during engine start-up. Under such conditions, there may occur high levels of angular movement of the camshaft(s) because the phaser oil supply pressure is not sufficiently high to control the phase.

To prevent such uncontrolled phase fluctuation of the phaser at times when the hydraulic pressure required for actuation of the phaser is below a predetermined value, it is known, for example from US2003/0196621, to provide a phaser with a spring biased locking pin for directly coupling the drive and driven members of the phaser for rotation with one another. The pin is hydraulically retracting when the hydraulic pressure attains the predetermined value to allow normal operation of the phaser.

EP 1234954 describes a vane-type phaser which allows the phase of two camshafts to be varied relative to the crankshaft. In such a twin phaser, it would in principle be possible to provide two separate locking pins, each for locking the drive member relative to a respective one of the two driven members but in practice there is not sufficient space to accommodate two locking pins.

SUMMARY OF THE INVENTION

With a view to overcoming the foregoing difficulty, the present invention provides a twin phaser comprising a drive member and two driven members arranged coaxially with one another, variable volume main working chambers defined between the members which serve to couple the drive member hydraulically to the two driven members and to vary the angular position of the drive member relative to the driven members, and locking means for locking the drive member to the driven members when the pressure in the working chambers is below a predetermined value, wherein the locking means comprise two coaxial locking pins mounted in a common bore in the centrally located member, bores in the two outer members, a resilient member for urging the pins away from one another into the bores in the two outer members, and further hydraulic chambers for urging the pins towards one another to retract them from the bores in the outer members when the hydraulic pressure in the main working chambers attains the predetermined value.

The use of coaxial locking pins in a twin vane-type phaser requires significantly less space which enables the adjustment range of the phaser to be increased. Furthermore, mounting of two locking pins coaxially reduces the component count and hence the manufacturing cost.

In one embodiment of the invention, two pistons of the same diameter are arranged back to back in a common cylindrical bore in the central member, each carrying a respective locking pin and the pistons being urged apart by a spring located between them.

While it is possible for the two pistons to be totally separate from one another, this places restrictions on the axial depth of the pistons and increases the risk of one of the pistons becoming seized within the bore.

In an embodiment of the invention designed to reduce the risk of the pistons seizing in their bore, one of the pistons is formed with a tubular extension having a smaller outer diameter than the bore in the central member and the second piston is provided with an axially projecting rod which is received within and guide by the tubular extension of the first piston.

A collar or land is preferably provided within the bore in the drive member to act as an end stop for the two pistons.

In an alternative embodiment of the invention, a first piston, which carries one locking pin and is guided in a cylindrical bore in the central member, is formed as a hollow piston with an internal bore receiving a second piston of smaller diameter carrying the second locking pin, a spring being arranged within the bore of the first piston to urge the two pistons apart.

In this case, one of the outer members may itself act as an end stop for the first piston, avoiding the need for an end stop for the two pistons to be provided within the bore in the drive member, as required in the previously described embodiments of the invention.

In all the embodiments of the invention, to avoid a hydraulic lock up of the pistons, it is important for the space within the bore of the drive member between the two pistons to be vented so that fluids, usually engine oil, can enter into it and be expelled from it freely.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
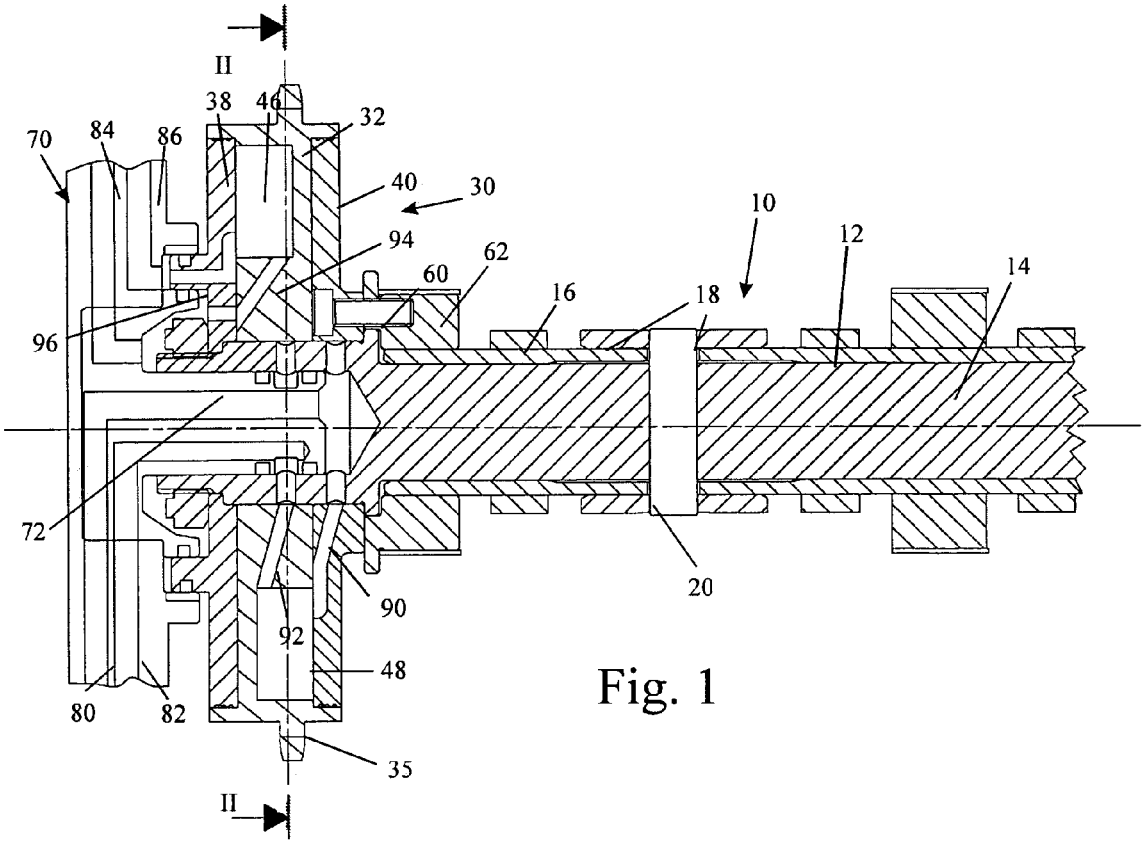
FIG. 1 is a longitudinal section through a twin vane-type phaser as disclosed in EP-A-01234954, the section being in the plane represented by the section line I-I in FIG. 2.

FIG. 1 shows a section through an assembled camshaft 10 with a twin vane-type phaser incorporated into its drive sprocket 30. The camshaft assembly comprises an inner shaft 14 surrounded by an outer sleeve or tube 12 which can rotate relative to the shaft 14 through a limited angle. One set of cams 16 is directly connected to the outer tube 12. A second set of cams 18 is freely journalled on the outer tube 12 and is connected to the inner shaft 14 by pins which pass through tangentially elongated slots in the outer tube 12.

The end of the inner shaft 14 that projects at the front end of the engine carries the drive sprocket 30. The operation of the phaser in the drive sprocket 30 is best understood from the exploded view shown in FIG. 3. The phaser comprises a drive member 32 in the form of a thick disk 34 which is formed with sprocket teeth 35 and is driven by the engine crankshaft. Of course, the drive member 32 could equally be part of a chain sprocket or a toothed belt pulley.

The drive member 32 is formed on its opposite sides with shallow recesses 36 to receive two driven members 38 and 40. As will be seen in FIG. 1, the first driven member 38 is keyed in for rotation with the inner shaft 14 of the assembled camshaft while the second driven member 40 is connected to the outer tube 12 by bolts 60 that are screwed into the front camshaft support 62.

Additionally, the drive member 32 is formed on each side with further arcuate blind recesses 42 and 44 which are covered by the respective driven members 38 and 40 to form sealed hydraulic cavities. Each of the cavities is divided into two working chambers by radial vanes 46 and 48. Various ports are formed in the drive member 32 to establish a hydraulic connection to the two working chambers, the ports being more fully described in EP-A-1234594.

The hydraulic controls for the two driven members are completely independent of one another. The cavities 42 and vanes 46 form a first vane-type coupling that rotates the first driven member 38 in relation to the drive member 32, while the cavities 44 on the opposite side of the drive member 32 and the vanes 48 form a second vane-type coupling that adjusts the phase of the second driven member 40.

To supply oil to the different working chambers of the two sets of jacks, the engine front cover 70 is formed with a spigot 72 that is received in a bore at the front end of the inner shaft 14. Suitable rotary seals are provided between the stationary front cover 70 and the rotating drive and driven members. Hydraulic lines 80, 82, in the engine front cover, communicate with ports 90 and 92 respectively that are formed in the driven member 40 and the drive member 32 and that lead to the working chambers on the opposite sides of the vanes 48. Similarly, hydraulic lines 84 and 86 in the front cover 70 communicate with ports 94 and 96 respectively that are formed in the drive member 32 and the driven member 38, and that lead to the working chambers on the opposite sides of the vanes 46.

Figure 2:
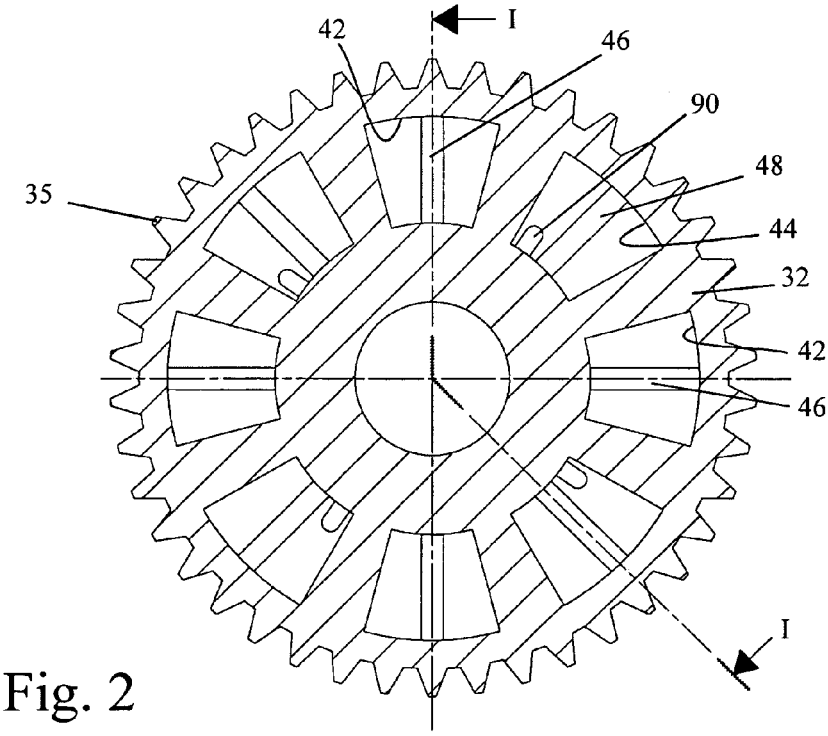
FIG. 2 is a transverse section in the plane represented by the line II-II in FIG. 1.
Figure 3:
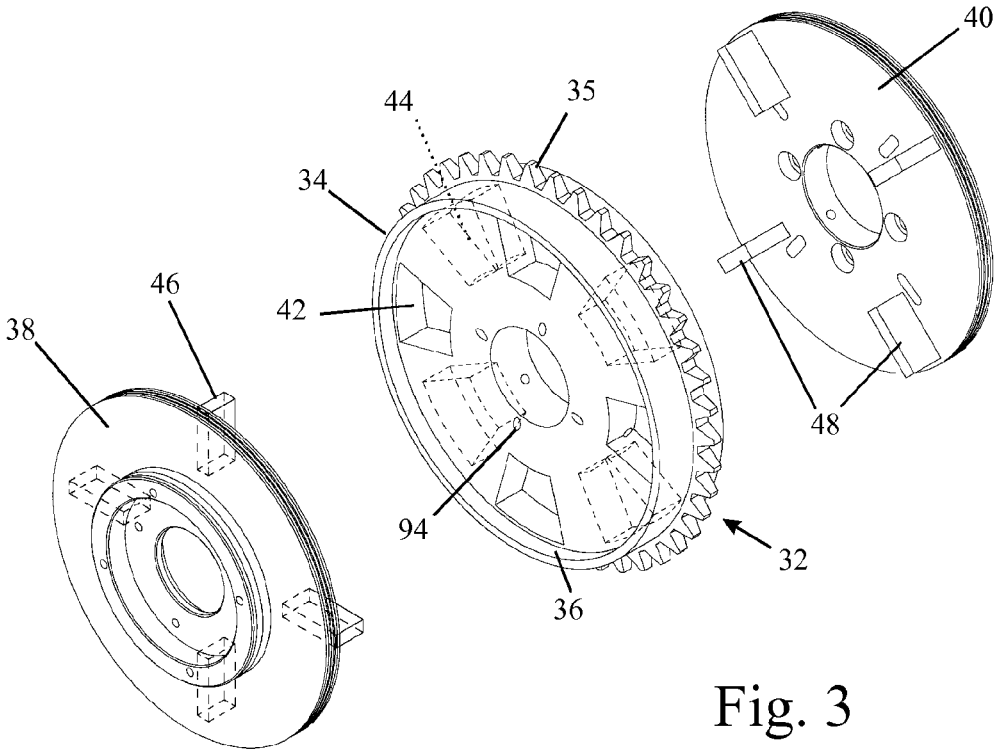
FIG. 3 is an exploded perspective view of the drive member and the two driven members of the mechanism shown in FIGS. 1 and 2.

The twin vane-type phaser of FIGS. 1 to 3 can only operate correctly when the oil pressure has reached a minimum level. While the engine is being started, it takes some time for the oil pressure to build up and during this time the phase of the driven members is uncontrolled. To overcome this disadvantage, the present invention provides a locking mechanism, as will now be described with reference to FIGS. 4 to 9, which locks the drive member to the driven members and is automatically released as soon as the oil pressure reaches a sufficiently high level to enable the phaser to perform its function correctly.

Each of the embodiments described in FIGS. 4 to 9 comprises two coaxial locking pins arranged back to back in a bore that is formed in the drive member 32 in between two of the cavities. It is necessary to ensure that there is sufficient space between two of the cavities to accept a bore for receiving the locking pins and, as will be clear from FIG. 2, providing two separate locking pins arranged in different bores would reduce the space available for the cavities and would therefore adversely affect the adjustment range of the phaser.

Figure 4:
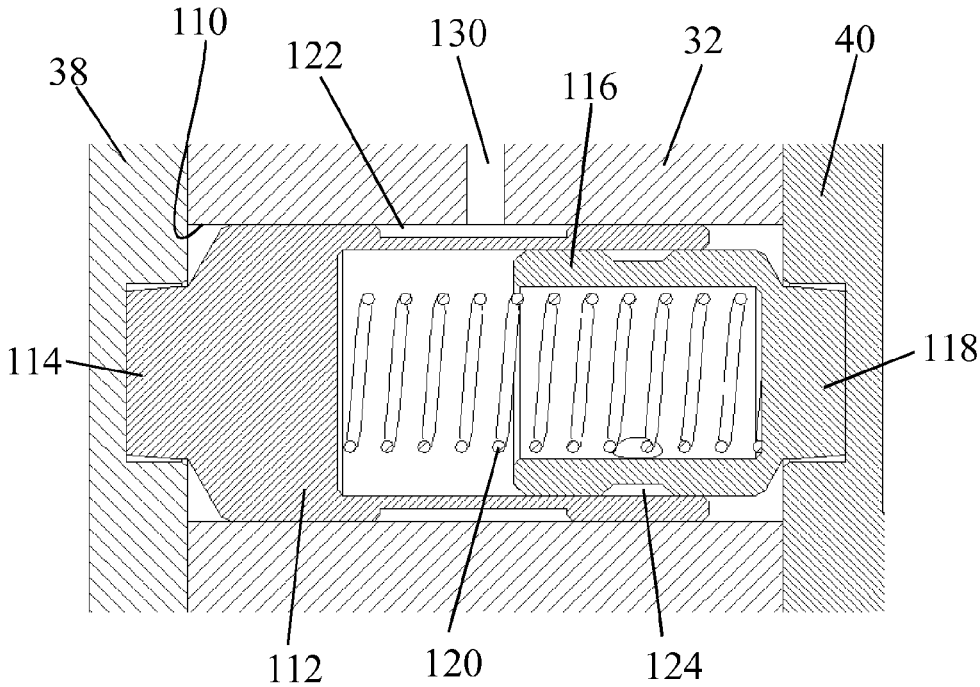
FIG. 4 is a section through a first locking mechanism for use in a twin vane-type phaser as illustrated in FIGS. 1 to 3.
Figure 5:
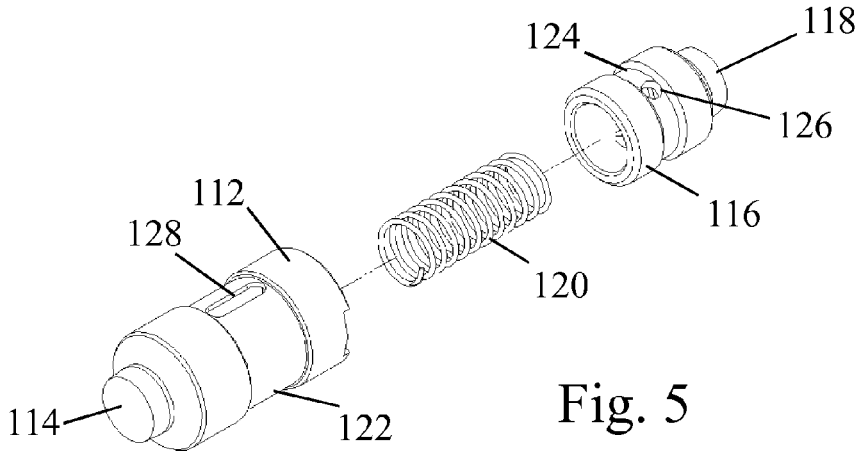
FIG. 5 is an exploded view of the components of the locking mechanism in FIG. 4.

In FIG. 4, the drive member 32 is formed with a cylindrical bore 110 in which there is slidably mounted a piston 112. The piston 112 carries a locking pin 114 which engages in a bore in the driven member 38 to prevent it from rotating relative to the drive member 32 when the oil pressure is low. A second piston 116 is slidably received in a blind bore formed in the opposite end of the piston 112 and it carries a locking pin 118 which locks the driven member 40 relative to the drive member. A spring 120 urges the two pistons 112 and 116 apart to lock both driven members 38 and 40 relative to the drive member 32 when the oil pressure is low.

Passages (not shown) formed by grooves in the end faces of the drive member 32 connect the opposite ends of the bore 110 to oil filled cavities, such as the cavity 42. Thus the prevailing oil supply pressure acts on the opposite ends of the two pistons 112, 116 in opposition to the spring 120. As soon as the oil pressure reaches a level at which the phaser can function correctly, the piston 112 is moved to the right, as shown, until it abuts the driven member 40 and the piston 116 is moved to the left until it sits entirely within the piston 112. In this way, in all the embodiments of the invention described herein, the oil pressure acts to retract the pins 114, 118 from the bore in the driven members 38 and 40, thereby releasing the locking mechanism and allowing the phaser to function normally.

It is important to vent the space between the two pistons, which is filled with oil, so as to avoid a hydraulic lock that would prevent retraction of the pins 114 and 118. For this reason, the two pistons are formed with grooves 122 and 124 and apertures 126 and 128 which communicate the space between the pistons 112, 116 with an oil return line 130 formed in the drive member 30.

Figure 6:
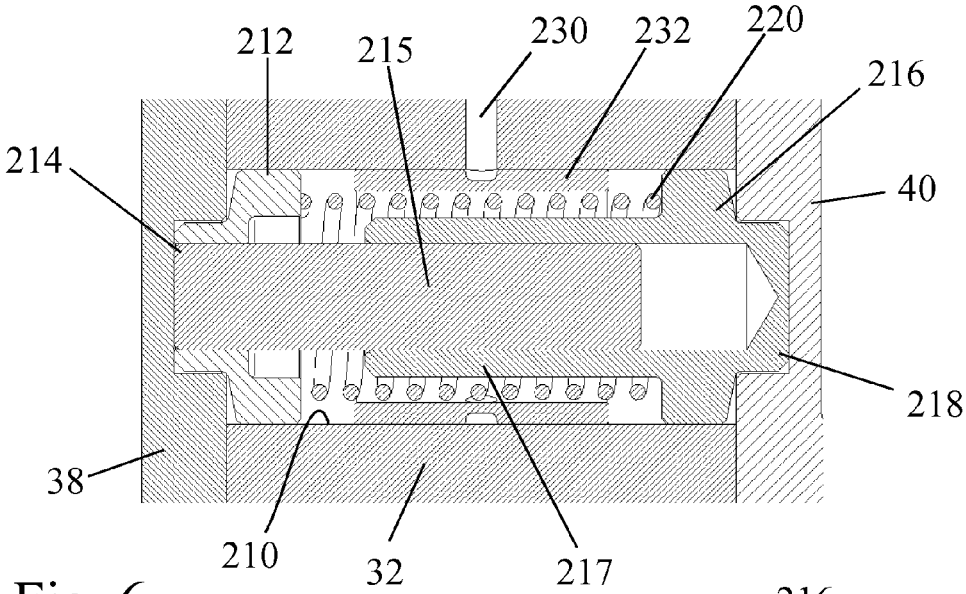
FIG. 6 is a section through a second locking mechanism for use in a twin vane-type phaser.
Figure 7:
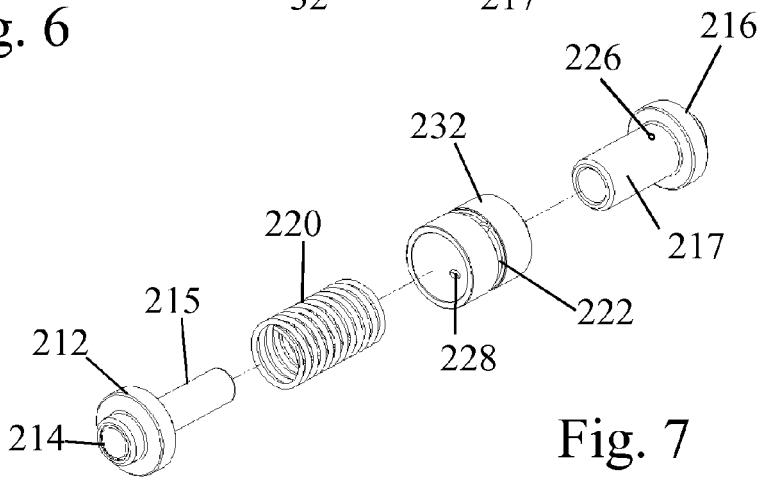
FIG. 7 is an exploded view of the components of the locking mechanism in FIG. 6.

In the embodiment of FIGS. 6 and 7, two pistons 212, 216 in a common bore 210, carry pins 214 and 218 and are urged apart by a spring 220. In this case, the two pistons have the same outer diameter and their stroke is limited by an abutment collar 232 retained or integrally formed within the bore 210. The piston 216 has a tubular axial extension 215 which receives a rod projecting axially from the piston 212 to help prevent the pistons from seizing within the bore 210. Once again the space between the pistons 212, 216 and the interior of the tubular extension 217 communicates with a venting line 230 in the drive member 32 through an aperture 226 in the tubular extension 217 and an annular groove 222 and an aperture 228 in the collar 232.

Figure 8:
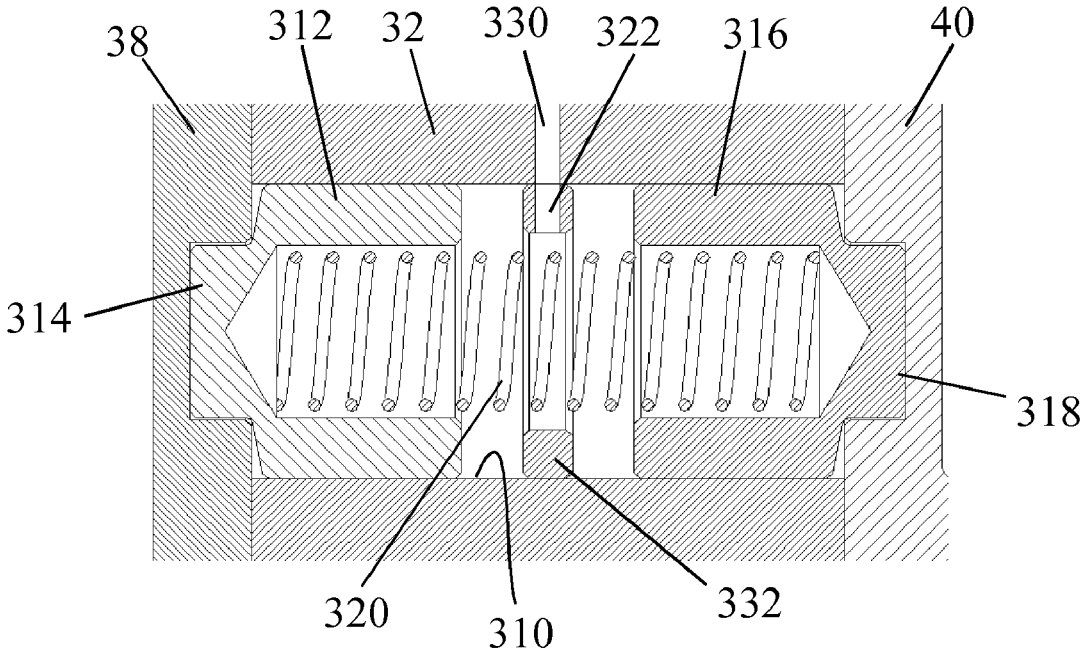
FIG. 8 is a section through a third locking mechanism for use in a twin vane-type phaser.
Figure 9:
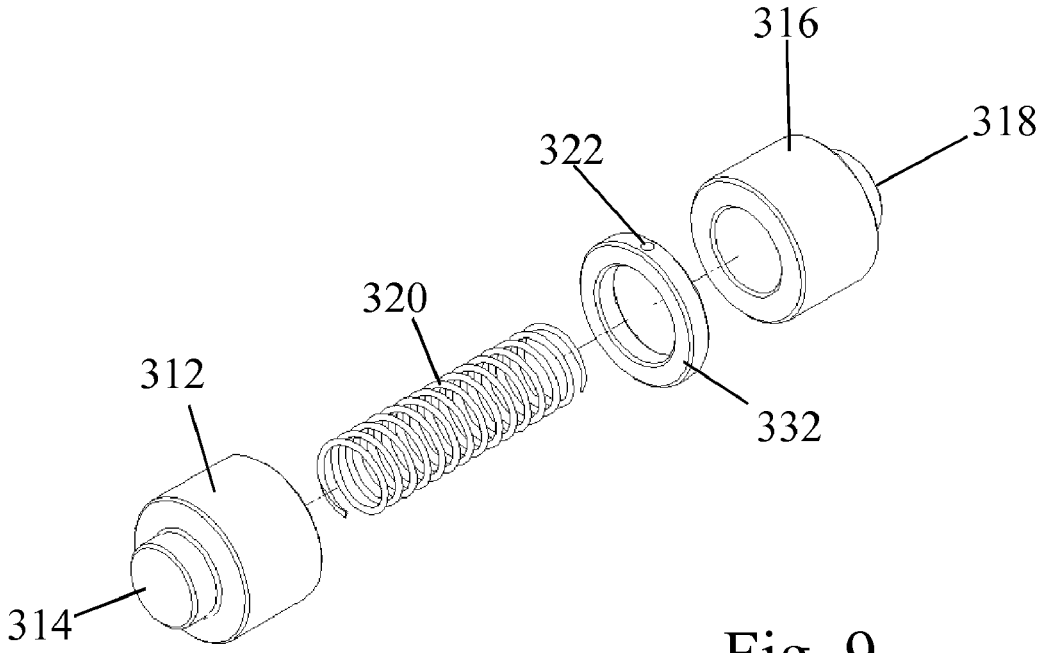
FIG. 9 is an exploded view of the components of the locking mechanism in FIG. 8.

In the embodiment of FIGS. 8 and 9, each of the pistons 312, 316 carrying the locking pins 314, 318 is guided by a bore 310 but is sufficiently long to avoid the risk of seizing and there is no need for the pistons to be guided by one another. A shorter abutment collar 332 is required to act as an end stop for the pistons. The pistons are in this case identical, helping to reduce manufacturing cost and a spring 320 fits within blind bores in the pistons to urge them axially apart. The space between the pistons is communicated with a venting line 330 through an aperture 322 in the abutment collar 332.

While the invention has been illustrated and described by reference to preferred embodiments, it will be clear that the invention is not so limited. Numerous modifications, changes, variations, substitutions and equivalents will occur to those skilled in the art without departing from the spirit and scope of the present invention as defined by the appended claims.

The invention claimed is:

1. A twin phaser comprising a drive member and two driven members arranged coaxially with one another, variable volume main working chambers defined between the members which serve to couple the drive member hydraulically to the two driven members and to vary the angular position of the drive member relative to the driven members, and locking means for locking the drive member to the driven members when the pressure in the working chambers is below a predetermined value, wherein the locking means comprise two coaxial locking pins mounted in a common bore in the centrally located member, bores in the two outer members, a resilient member for urging the pins away from one another into the bores in the two outer members, and further hydraulic chambers for urging the pins towards one another to retract them from the bores in the outer members when the hydraulic pressure in the main working chambers attains the predetermined value and wherein two pistons of the same diameter, each carrying a respective locking pin, are arranged back to back in a common cylindrical bore in the drive member, the pistons being urged apart by a spring located between them, and the space within the bore of the drive member between the two pistons is vented to allow fluids to enter and leave freely, in order to avoid hydraulic lock up of the pistons.

2. A twin phaser as claimed in claim 1, wherein the two pistons are totally separate from, and do not interact with, one another.

3. A twin phaser as claimed in claim 1, wherein one of the pistons is formed with a tubular extension having a smaller outer diameter than the bore in the central member and the second piston is provided with an axially projecting rod which is received within and guided by the tubular extension of the first piston.

4. A twin phaser as claimed in claim 1, wherein a collar is retained within the bore in the drive member to act as an end stop for the two pistons.

5. A twin phaser as claimed in claim 1, wherein a collar is formed integrally within the bore in the drive member to act as an end stop for the two pistons.

6. A twin phaser comprising a drive member and two driven members arranged coaxially with one another, variable volume main working chambers defined between the members which serve to couple the drive member hydraulically to the two driven members and to vary the angular position of the drive member relative to the driven members, and locking means for locking the drive member to the driven members when the pressure in the working chambers is below a predetermined value, wherein the locking means comprise two coaxial locking pins mounted in a common bore in the centrally located member, bores in the two outer members, a resilient member for urging the pins away from one another into the bores in the two outer members, and further hydraulic chambers for urging the pins towards one another to retract them from the bores in the outer members when the hydraulic pressure in the main working chambers attains the predetermined value, and wherein the locking means comprise two pistons of which a first piston carries one locking pin, is guided in a cylindrical bore in the central member, and is formed as a hollow piston with an internal bore and a second piston is of smaller diameter than the first piston, is received within the internal bore of the first piston and carries the second locking pin, a spring being arranged within the internal bore of the first piston to urge the two pistons apart.

7. A twin phaser as claimed in claim 6, wherein, in order to avoid a hydraulic lock up of the pistons, the space within the bore of the drive member between the two pistons is vented to allow fluids to enter and leave freely.

* * * * *